US009884701B2

(12) United States Patent
Forrest et al.

(10) Patent No.: US 9,884,701 B2
(45) Date of Patent: Feb. 6, 2018

(54) ECOLOGY CAN END WITH PRESSURE EQUALIZATION PORT

(71) Applicant: Rexam Beverage Can Company, Chicago, IL (US)

(72) Inventors: Randall G. Forrest, Park Ridge, IL (US); Michael R. Gogola, Itasca, IL (US)

(73) Assignee: REXAM BEVERAGE CAN COMPANY, Chicago, IL (US)

( * ) Notice: Subject to any disclaimer, the term of this patent is extended or adjusted under 35 U.S.C. 154(b) by 264 days.

(21) Appl. No.: 14/312,296

(22) Filed: Jun. 23, 2014

(65) Prior Publication Data

US 2015/0367984 A1 Dec. 24, 2015

(51) Int. Cl.

*B65D 17/34* (2006.01)
*B65D 17/00* (2006.01)
*B65D 47/32* (2006.01)

(52) U.S. Cl.

CPC ..... *B65D 17/165* (2013.01); *B65D 47/32* (2013.01); *B65D 2517/0013* (2013.01); *B65D 2517/0014* (2013.01); *B65D 2517/0062* (2013.01); *B65D 2517/0071* (2013.01); *B65D 2517/0074* (2013.01); *B65D 2517/0082* (2013.01); *B65D 2517/0091* (2013.01); *B65D 2517/0092* (2013.01)

(58) Field of Classification Search

CPC ..... B65D 17/165; B65D 47/32; B65D 2517/0013; B65D 2517/0091; B65D 2517/0014; B65D 2517/0062; B65D 2517/0071; B65D 2517/0074; B65D 2517/0082; B65D 2517/0092

USPC ..... 220/269, 271, 270, 273, 906; 215/250

See application file for complete search history.

(56) References Cited

U.S. PATENT DOCUMENTS 3,325,043 A 6/1967 Henchert et al.
3,744,667 A 7/1973 Fraze et al.
(Continued)

FOREIGN PATENT DOCUMENTS

FR 2293369 A1 7/1976
JP 3682999 B2 6/2005
(Continued)

OTHER PUBLICATIONS

European Patent Office Acting as the International Searching Authority, International Search Report issued in Application No. PCT/US2015/037147 of Rexam Beverage Can Company, dated Oct. 6, 2015.

*Primary Examiner* — Fenn C Mathew
*Assistant Examiner* — Elizabeth Volz
(74) *Attorney, Agent, or Firm* — Greer, Burns & Crain, Ltd.

(57) ABSTRACT

An ecology stay-on tab beverage can end has a first curvilinear segment of frangible score severable to form a vent region and a pressure equalization port. A second curvilinear segment of frangible score has opposing terminal ends separated by a hinge segment of the center panel. The second curvilinear segment of frangible score is severable to form a pour opening. A lifting of a lift end of a tab actuates an opening sequence in which the first curvilinear segment of frangible score is severed causing the vent region and the pressure equalization port to form before the pour opening is completely formed.

21 Claims, 14 Drawing Sheets

(56) References Cited

U.S. PATENT DOCUMENTS

| | | | | | |
|---|---|---|---|---|---|
| 4,205,760 | A | | 6/1980 | Hasegawa | |
| 4,572,398 | A | | 2/1986 | Juty | |
| 4,576,306 | A | | 3/1986 | Kelsey et al. | |
| 5,011,037 | A | | 4/1991 | Moen et al. | |
| 5,307,947 | A | * | 5/1994 | Moen | B65D 17/165 220/266 |
| 5,335,808 | A | * | 8/1994 | Lee | B65D 17/165 220/269 |
| 5,375,729 | A | * | 12/1994 | Schubert | B65D 17/165 220/269 |
| 5,555,992 | A | * | 9/1996 | Sedgeley | B65D 17/165 220/269 |
| 5,692,636 | A | | 12/1997 | Schubert | |
| 5,738,237 | A | | 4/1998 | McEldowney | |
| 5,819,973 | A | | 10/1998 | Traub, Sr. et al. | |
| 5,860,553 | A | | 1/1999 | Schubert | |
| 6,024,239 | A | | 2/2000 | Turner et al. | |
| 6,079,583 | A | | 6/2000 | Chasteen | |
| 6,354,453 | B1 | | 3/2002 | Chasteen | |
| 6,715,629 | B2 | | 4/2004 | Hartman et al. | |
| 6,761,281 | B2 | | 7/2004 | Hartman | |
| 7,513,383 | B2 | | 4/2009 | Hwang | |
| 7,594,585 | B1 | | 9/2009 | Fields | |
| 7,748,557 | B2 | * | 7/2010 | Robinson | B65D 17/165 206/459.5 |
| 7,975,884 | B2 | | 7/2011 | Mathabel et al. | |
| D650,276 | S | | 12/2011 | Nesling et al. | |
| D650,277 | S | | 12/2011 | Nesling et al. | |
| D650,278 | S | | 12/2011 | Nesling et al. | |
| 8,196,767 | B2 | | 6/2012 | Fields | |
| 2003/0189045 | A1 | * | 10/2003 | Hwang | B65D 17/165 220/269 |
| 2009/0200306 | A1 | | 8/2009 | Breunig | |
| 2011/0266281 | A1 | | 11/2011 | Thiemann et al. | |
| 2013/0126529 | A1 | * | 5/2013 | Nesling | B65D 17/165 220/271 |

FOREIGN PATENT DOCUMENTS

| | | | | |
|---|---|---|---|---|
| WO | 2004009459 | A1 | 1/2004 | |
| WO | WO2004009459 | * | 1/2004 | B65D 17/34 |
| WO | 2011136860 | A1 | 11/2011 | |

* cited by examiner

ECOLOGY CAN END WITH PRESSURE EQUALIZATION PORT

CROSS-REFERENCE TO RELATED APPLICATIONS

N/A

FEDERALLY SPONSORED RESEARCH OR DEVELOPMENT

N/A

TECHNICAL FIELD

The invention relates to ecology-type stay-on tab beverage can ends; more particularly, the present invention is directed to such a beverage can end with a pressure equalization port which is openable without manually rotating the stay-on tab during an opening sequence.

BACKGROUND OF THE INVENTION

Typical end closures for beer and beverage containers have an opening panel and an attached leverage tab for pushing the opening panel into the container to open the end. The container is typically a drawn and ironed metal can, usually constructed from a thin plate of aluminum. End closures for such containers are also typically constructed from a cutedge of thin plate of aluminum or steel, formed into a blank end, and manufactured into a finished end by a process often referred to as end conversion. These ends are formed in the process of first forming a cutedge of thin metal, forming a blank end from the cutedge, and converting the blank into an end closure which may be seamed onto a container.

These types of container ends have been used for many years, with almost all such ends in use today being the "ecology" or "stay-on-tab" ("SOT") ends in which the tab remains attached to the end after a tear panel, including large-opening ends ("LOE"), is opened. The tear panel being a portion of the can end defined by a frangible score length. The tear panel may be opened, that is the score may be severed, and the tear panel displaced at an angular orientation relative to the remaining portion of the can end, thus creating a pour opening through which the beverage may be poured from the container. The tear panel remains hingeably connected to the remaining portion of the can end by a hinge segment, leaving an opening through which the user draws the contents of the container. In an LOE, the pour opening is about 0.5 square inches in area.

Opening of the tear panel is operated by the tab which is attached to the can end by a rivet through a rivet island on the tab. The tab is typically attached to the can end such that a nose of the tab extends over a proximal portion of the tear panel in a stowage position. A lift end of the tab is located opposite the tab nose and provides access for a user to lift the lift end, such as with the user's finger, to force the nose against the proximal portion of the tear panel. With most can ends, the stowage position and opening position are in the same location; however, some can ends known in the art require rotation of the tab from a stowage position to the opening position prior to an opening sequence, i.e. the fracturing of the frangible score.

When the tab nose is forced against the tear panel, the score initially ruptures at a vent region of the score. This initial rupture of the score is primarily caused by the lifting force on the tab resulting in lifting of a central region of the can end, including the rivet and immediately adjacent the rivet. As the tab is lifted further, the score rupture propagates along the length of the score, eventually stopping at the hinge segment.

Venting is an initial release of pressure from within a pressurized container upon initial fracture of the score about the tear panel, typically upon the initial lifting of the lift end of the tab by a user.

One problem associated with these opening systems is pourability of the beverage from the container. Because these ends are not typically outfitted with a pressure equalization aperture, the beverage may "glug" as air enters the beverage container through the pour opening to replace the volume of the quickly exiting beverage emptied from the container. "Glug" refers to an uneven flow caused by the outside air attempting to enter the container through the pour opening. Thus, pressure equalization differs from venting in that venting is the initial release of pressure in a pressurized container, i.e. the "pop", and pressure equalization is the act of replacing the volume of beverage with a volume of air.

Many years ago, prior to beverage containers having frangible tear panels of any sort, users opened beverage containers with church keys having a downturned sharpened beak used to pierce the end closure. The user would pierce the end closure twice creating a pour opening and an equalization opening. This method is often used today by beverage vendors at sporting stadiums and the like where speed of beverage delivery is important to serve many customers in short periods of time. Many efforts have been made to outfit SOT ends with some sort of equalization opening. None of these attempts have been universally adopted due in no small part to the significant drawbacks associated with each one.

For example, one method of improving pourability of SOT end closures involves enlarging the pour opening. However, the openings can rarely be made large enough to fully eliminate glugging. Additionally, when the openings are made very large, unwanted spillage becomes an issue from splashing, spewing, or spitting of the beverage through the very large pour opening. Moreover, the larger pour opening typically requires manual rotation of the tab about the rivet to apply tab nose forces in a plurality of locations on the closure to bend an enlarged tear panel into the container. Fully flexing a hinge region on the tab several times results in work hardening of the rivet island causing the metal to become brittle which could result in the tab undesirably breaking free from the closure. Also, the user must manually rotate the tab to a precise location without instruction in order for the tear panel to produce the larger pour opening.

Some designers have proposed providing a second tear panel in the end closure. These designs generally rely on use of an external puncturing tool, e.g. the church key, or using the SOT to open the second tear panel. Obviously requiring the user to supply an external puncturing tool is undesirable as it represents devolving of the art to the days of the church key. Using the SOT to open the second tear panel requires the manual rotating and flexing of the SOT described above which shares the drawbacks of the larger opening ends also described above. Finally, the size and location of these second tear panels are undesirable because the openings are too large resulting in spillage and/or too close to pour opening to create a sufficient pourability advantage.

One proposed method of eliminating manual rotation of the tab to open an equalization port requires providing a rocking tab or "teeter tauter" tab wherein one end of the tab is used to open the pour panel while the opposite end or some other portion of the tab is used to open the equalization port. However, rocking of the tab is undesirable because it could result in premature opening of one or both of the tear panels.

Efforts have placed such a vent feature close to or under the rivet island of the SOT and/or within a coined region surrounding the rivet. These features consist of a second frangible score that is fractured when the SOT is lifted to fracture the frangible score which partially defines the pour opening. These locations and methods are undesirable because they are located too close to the pour opening which could lead to unwanted spillage through the vent, and the method of severing does not provide the user with the option of using or not using the vent because the second score is automatically or naturally severed when the user fractures the main score partially defining the pour opening.

Another recent attempt at providing improved pour includes formation of a deboss channel at approximately a 1 o'clock position of the pour opening. There is some debate whether the deboss channel provides any improvement in pourability.

Thus, the problems associated with prior attempts to provide a pressure equalization port primarily center on the size and/or location of the port and/or method of opening. A non-exhaustive list of problems associated with these prior attempts includes the following singularly and in any combination: not providing the user an option of using/opening the port due to location, undesirably and/or unnecessarily too large, located too close to the dispensing opening, requires use of an enteral tool such as a church key, requires use of a user's finger to push down on the center panel in direct engagement therewith which could cause cuts on the user's finger due to sharp edges on the center panel, possible premature opening of the port, unacceptable/nonexistent pressure equalization within the container, and spills and splashes of the contents of the container. As is explained in greater detail below, the present invention reduces or eliminates these problems with container ends. The present invention provides variations for overcoming the specific difficulties associated with design, manufacture and use of large-open beverage container ends.

The present invention is provided to solve the problems discussed above and other problems, and to provide advantages and aspects not provided by prior end closures of this type. A full discussion of the features and advantages of the present invention is deferred to the following detailed description, which proceeds with reference to the accompanying drawings.

SUMMARY OF THE INVENTION

A first aspect of the present invention is directed to an ecology stay-on tab beverage can end. The ecology stay-on tab beverage can end has a circumferential curl centered about a longitudinal axis. A circumferential wall extends downwardly from the curl. A circumferential strengthening member is located downwardly from the wall. A center panel is located radially inwardly from the strengthening member and is centered about the longitudinal axis. The center panel has a rivet which attaches a tab to the center panel. A first curvilinear segment of frangible score is severable to form a vent opening and a pressure equalization port. A second curvilinear segment of frangible score has opposing terminal ends separated by a non-frangible hinge segment of the center panel. The second curvilinear segment of frangible score is severable to form a pour opening. A lifting of a lift end the tab actuates an opening sequence in which the first curvilinear segment of frangible score is severed causing the vent opening and the pressure equalization port to form before the pour opening is completely formed.

The first aspect of the invention may include one or more of the following features, alone or in any reasonable combination. The ecology stay-on tab beverage can end may further comprise a tear panel defined by the second curvilinear segment of frangible score and the non-frangible hinge segment which retains the tear panel to an adjacent portion of the center panel when the pour opening is formed, and a first diametric axis of the ecology stay-on tab beverage can end which extends lengthwise through the tab from the lift end of the tab to a nose end of the tab opposite the lift end wherein a portion of the nose end of the tab lying within an arc area of a circular arc subtending a 90 degree angle, having a center point at the center point of the rivet and bisected by the first diametric axis, has a segment located outwardly of the tear panel when the lifting of the lift end of the tab actuates the opening sequence; this segment of the nose end of the tab may first contact a portion of the center panel located beyond a boundary of the tear panel during initial lifting of the lift end of the tab which actuates the opening sequence. The nose end of the tab may have a cleat which extends over the tear panel when the lifting of the lift end of the tab actuates the opening sequence. The ecology stay-on tab beverage can end may further comprise a first diametric axis of the ecology stay-on beverage tab extending lengthwise through the tab from the lift end of the tab to a nose end of the tab opposite the lift end when the tab is in position to begin the opening sequence, a second diametric axis perpendicular to the first diametric axis wherein four quadrants of substantially equal area of the ecology stay-on tab beverage can end are formed, and a score line having opposing terminal ends and comprising the first curvilinear segment of frangible score and the second curvilinear segment of frangible score therebetween, wherein the score line has portions located in each of the four quadrants. The tab may comprise a central webbing and a void region partially surrounding a rivet island, wherein the void region has opposing legs extending along opposite sides of the rivet island, wherein the rivet island has a rivet hole through which the rivet passes, and wherein the rivet hole is offset on the rivet island such that it is located closer to a first opposing leg than a second opposing leg. The ecology stay-on tab beverage can end may further comprise a tear panel defined by the second curvilinear segment of frangible score and the non-frangible hinge segment which retains the tear panel to an adjacent portion of the center panel when the pour opening is formed and a raised ramp which is located on the center panel outwardly of the tear panel, wherein a portion of the nose end of the tab engages the raised ramp during the opening sequence, wherein a force provided by the tab nose to the center panel migrates towards the tear panel as a result of the tab engaging the raised ramp. The opening sequence may comprise, in order, formation of the vent opening and formation of the pressure equalization port upon severing the first curvilinear segment of frangible score until the severing of the first curvilinear segment of frangible score ceases. The ecology stay-on tab beverage can end may further comprise a score line having opposing terminal ends and comprising the first curvilinear segment of frangible score adjacent a first terminal end of the score line and extending therefrom and a non-frangible segment of the score line joining the first curvilinear segment of frangible score with the second curvilinear segment of frangible score, wherein the second curvilinear segment of frangible score extends from the non-frangible segment of the score line to a second terminal end of the score line. The pour opening may have an area no less than 0.25 square inches. The pour opening may be created as the lifting of the tab continues without manual rotation of the tab by a user. The ecology stay-on tab beverage can end may further comprise a score line having opposing terminal ends and comprising the first curvilinear segment of frangible score adjacent a first terminal end of the score line and extending therefrom and a third curvilinear segment of frangible score of the score line joining the first curvilinear segment of frangible score with the second curvilinear segment of frangible score, wherein the second curvilinear segment of frangible score extends from the third curvilinear segment of frangible score line to a second terminal end of the score line. The lifting of the tab may occur from a stowage position of the tab without manual rotation of tab prior to lifting of the tab from the stowage position. The opening sequence may be completed without manually rotating the rivet island of the tab about the rivet. The nose end 30 may be defined by a portion of a perimeter of the tab including a curl which is located within an arc area of a circular arc subtending a 90 degree angle and wherein the circular arc has a center point at the center point of the rivet and is bisected by the first diametric axis. Lifting of the tab may cause the rivet island of the tab to rotate about rivet without conscious tab rotation provided by a user. The first and second curvilinear segments of frangible score may form portions of a score line, wherein the score line further comprises a fork, and during the opening sequence, fracture of the score line is bi-directional, simultaneously continuing in a first path along the first curvilinear segment of frangible score and in a second path along a bypass segment of frangible score to the second curvilinear segment of frangible score. During the opening sequence, according to a clock-like reference, a fracture of the first curvilinear segment of frangible score may proceed in a first direction to form the pressure equalization port as a fracture of the second curvilinear segment of frangible score proceeds in an opposite direction to form a pour opening.

A second aspect of the invention is also directed to an ecology stay-on tab beverage can end. The ecology stay-on tab beverage can end comprises a circumferential curl centered about a longitudinal axis. A circumferential wall extends downwardly from the curl. A circumferential strengthening member is located downwardly from the wall. A center panel is located radially inwardly from the strengthening member and is centered about the longitudinal axis. A rivet attaches a tab to the center panel. A first curvilinear segment of frangible score is severable to form a vent region and a pressure equalization port. A second curvilinear segment of frangible score has opposing terminal ends separated by a non-frangible hinge segment of the center panel. The second curvilinear segment of frangible score is severable to form a pour opening. A lifting of a lift end the tab actuates an opening sequence in which a force provided by the nose end of the tab to the center panel migrates from a location outside a boundary of the tear panel to a location within the boundary of the tear panel.

A third aspect of the invention is also directed to an ecology stay-on tab beverage can end. The ecology stay-on tab beverage can end comprises a circumferential curl centered about a longitudinal axis. A circumferential wall extends downwardly from the curl. A circumferential strengthening member is located downwardly from the wall. A center panel is located radially inwardly from the strengthening member and is centered about the longitudinal axis. A tear panel is defined by a frangible score having terminal ends separated by a non-frangible hinge segment which retains the tear panel to the center panel upon opening the ecology stay-on tab beverage can end. A rivet attaches a tab to the center panel. The tab comprises central webbing, a rivet island having a rivet hole through which the rivet passes, a void region partially surrounding a rivet island having opposing legs extending along opposite sides of the rivet island, and a tab hinge extending from between the opposing legs. The rivet hole is offset on the rivet island such that it is located closer to a first opposing leg than a second opposing leg.

A fourth aspect of the invention is also directed to an ecology stay-on tab beverage can end. The ecology stay-on tab beverage can end comprises a circumferential curl centered about a longitudinal axis. A circumferential wall extends downwardly from the curl. A circumferential strengthening member is located downwardly from the wall. A center panel is located radially inwardly from the strengthening member and is centered about the longitudinal axis. A tab is attached to the center panel. A tear panel is defined by a frangible score having terminal ends separated by a non-frangible hinge segment which retains the tear panel to the center panel upon opening the ecology stay-on tab beverage can end. A single lifting motion of a lift end of the tab without manually rotating the rivet island about the rivet creates, in order, a vent opening, a pressure equalization port and a pour opening. The ecology stay-on tab beverage can end may further comprise a raised ramp forming a tapered surface on a public side of the center panel wherein engagement by a nose end of the tab with the raised ramp causes rotation of the rivet island about the rivet during the single lifting motion of the lift end of the tab.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
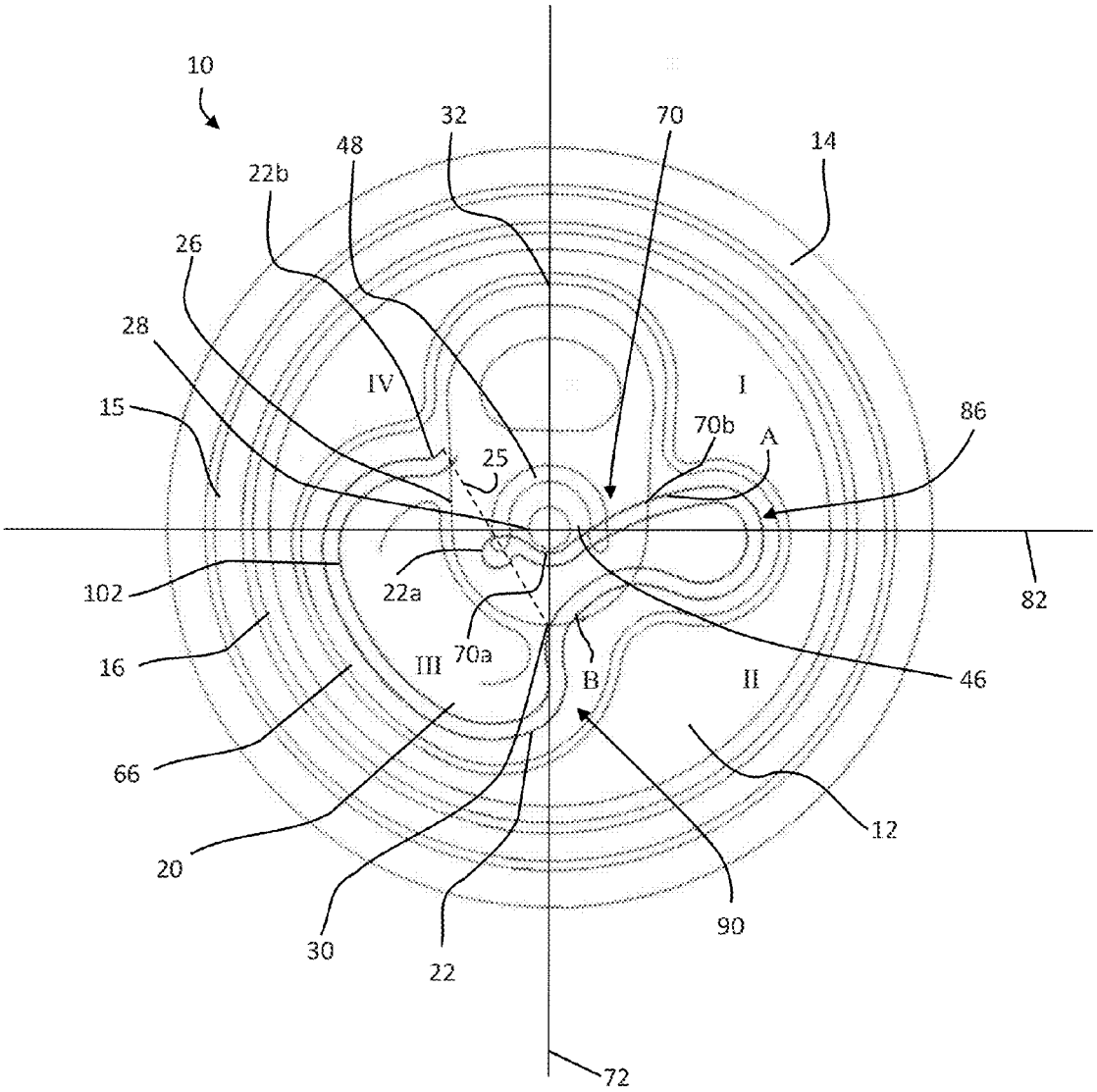
FIG. 1 is a top view of an embodiment of the present invention with a substantially translucent tab to reveal structure of a can end beneath the tab.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention provides a can end aimed at providing a suitable pressure equalization port which allows a volume of fluid to enter a headspace above a beverage within a beverage container. This allows the beverage to pour more smoothly and rapidly through a pour opening in the can end. The pressure equalization port allows the fluid to enter the headspace to replace the volume of the quickly exiting liquid beverage emptied from the container through pour opening. The present invention is directed to a means for providing an automatically opening pressure equalization port that opens naturally during the course of an ecology SOT can end opening sequence. The pressure equalization port of the present invention is intended to overcome the drawbacks of prior such pressure equalization ports. More specifically, it is automatically openable rather than selectively openable. It is operable/openable by a tab already attached to the can end, and it is openable as a step in the ordinary opening sequence of the can end. Unlike some prior art tabs, it does not require manual rotation of the tab as will be described below or very little of such manual rotation. Instead, the tab will naturally rotate upon ordinary lifting of a lift end of the tab to open both the equalization port and a pour opening during the ordinary opening of the pour opening. Finally, it cannot be debated whether the pressure equalization port provides an improvement in pourability of the beverage from the beverage container.

Referring generally to the figures, a beverage can end 10 for a container has a center panel 12 separated from a seaming curl 14 by a circumferential wall 15 extending downwardly from the seaming curl 14 to a strengthening member 16 which is joined to the center panel 12. The container is typically a drawn and ironed metal can, usually constructed from a thin plate of aluminum or steel. Beverage can ends for such containers are also typically constructed from a cutedge of thin plate of aluminum or steel, formed into blank end, and manufactured into a finished end by a process often referred to as end conversion.

The can end 10 can be joined to a container body by the seaming curl 14 which is joined to a mating curl of the container body. The seaming curl 14 of the can end 10 is integral with the center panel 12 by the circumferential wall 15 and the strengthening member 16, typically either a generally U-shaped countersink or a fold, which is joined to a peripheral edge of the center panel 12, defining an outer perimeter of the center panel 12, often through an additional strengthening feature such as a circumferential step or other circumferential wall. This type of means for joining the center panel 12 to a container body is presently the typical means for joining used in the industry, and the curl structure described above is formed in the process of forming the blank end from a cutedge of metal plate, prior to the end conversion process. However, other means for joining the center panel to a container may be employed with the present invention.

The steps of manufacturing the can end 10 begin with blanking the cutedge, typically a round or non-round cutedge of thin metal plate. Examples of non-round cutedge blanks include elliptical cutedges, convoluted cutedges, and harmonic cutedges. A convoluted cutedge may be described as generally having three distinct diameters, each diameter being 45° relative to the others. The cutedge is then formed into a blank end by forming the seaming curl, countersink, panel radius and the center panel.

The conversion process for this type of beverage can end includes the following steps: forming a rivet by first forming a projecting bubble in the center of the panel and subsequently working the metal of the bubble into a button and into the more narrow projection of metal being the rivet; forming the tear panel by scoring the metal of the panel wall; forming an inner bead or panel on the tear panel; forming a deboss panel by bending the metal of the panel wall such that a central area of the panel wall is slightly lower than the remaining panel wall; staking the tab to the rivet; and other subsequent operations such as wipe-down steps to remove sharp edges of the tab, lettering on the panel wall by scoring, incising, or embossing (or debossing), and restriking the rivet island.

The seaming curl 14 defines an outer perimeter of the beverage can end 10. It is generally centered about a longitudinal or vertical axis 50, typically located at a center of the rivet.

Figure 9:
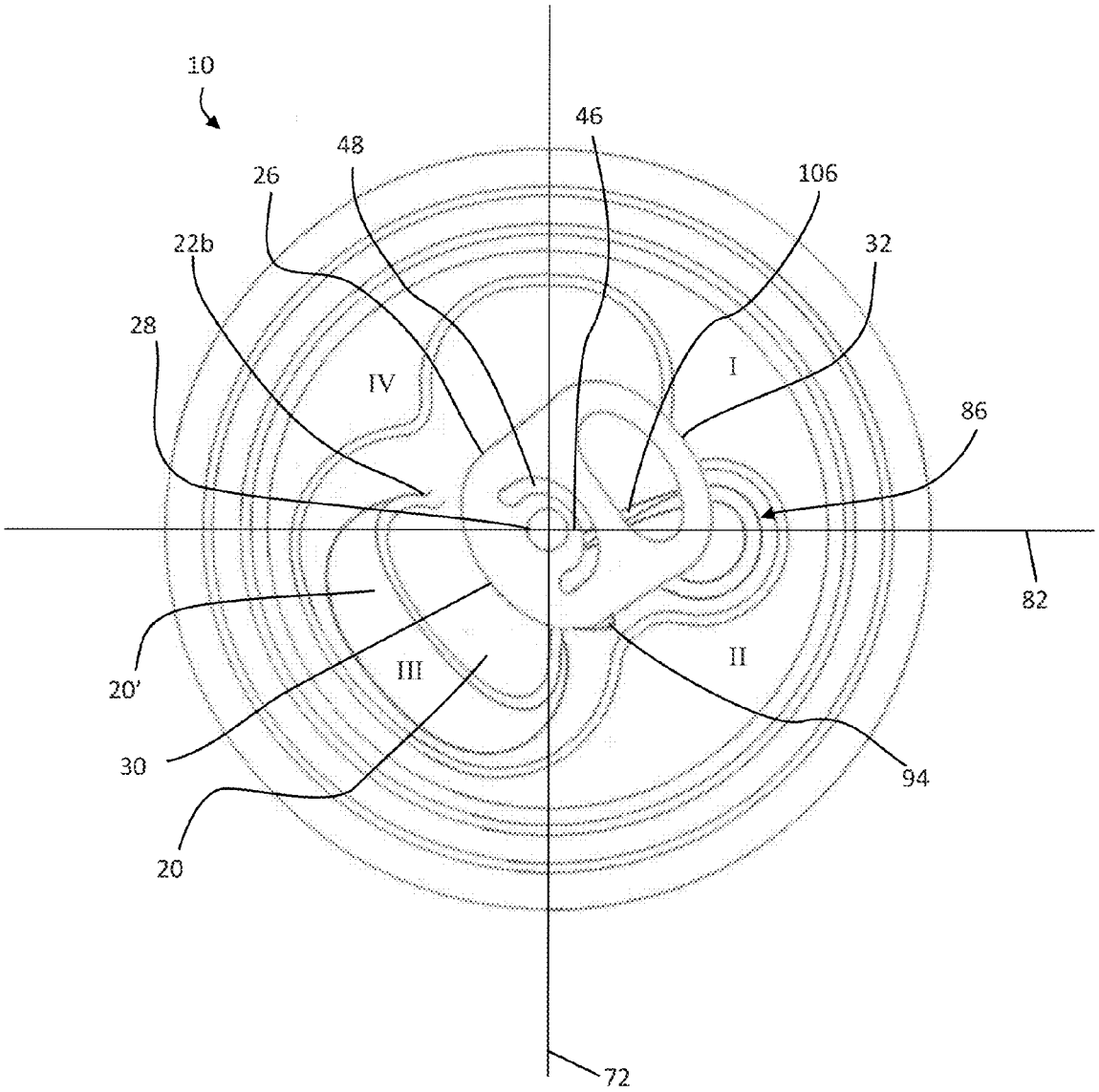
FIG. 9 is a top view of an embodiment of the present invention with a substantially opaque tab illustrating continued opening of a tear panel to form a pour opening and further automatic rotation of a tab upon continued lifting of a lift end of the tab by a user.

The center panel 12 has a displaceable tear panel 20 defined by a frangible score and a non-frangible hinge segment 25. The tear panel 20 of the center panel 12 may be opened, that is the frangible score may be severed and the tear panel 20 displaced at an angular orientation relative to the remaining portion of the center panel 12, while the tear panel 20 remains hingeably connected to the center panel 12 through the hinge segment, to define a dispensing port or pour opening 20' (see FIG. 9). In this opening operation, the tear panel 20 is displaced at an angular deflection. More specifically, the tear panel 20 is deflected at an angle relative to the plane of the center panel 12, with the vortex of the angular displacement being the hinge segment.

The tear panel 20 is formed during the conversion process by a scoring operation. The tools for scoring the tear panel 20 in the center panel 12 include an upper die on a public side 34 having a scoring knife edge in the shape of the tear panel 20, and a lower die on the product side to support the metal in the regions being scored. When the upper and lower dies are brought together, the metal of the panel wall 12 is scored between the dies. This results in the scoring knife edge being embedded into the metal of the panel wall 12, forming a score line 22 which appears as a wedge-shaped recess in the metal. The metal remaining below the wedge-shaped recess is the residual of the score line 22. Therefore, the score line 22 is formed by the scoring knife edge causing movement of metal, such that the imprint of the scoring knife edge is made in a public side 34 of the panel wall 12.

The center panel 12 has a public side 34 and an opposing product side 35 and further includes a tab 26. The tab 26 has a generally elongated body along a diametric axis 72 extending through a tab nose 30, a central webbing 42 and the lift end 32. Typical prior art can ends often have a tab 26 which is staked in the final steps of the conversion process by staking the area of the center panel 12 adjacent and under the rivet island 46 at an angle, to bias the tab 26 such that the lift end 32 of the tab 26 rests close to the center panel 12. The center panel 12 may also have a recess near the lift end 32 of the tab 26 to allow for easier finger access.

The opening of the tear panel 20 is operated by the tab 26 which is attached to the center panel 12 by a rivet 28 spaced from the tear panel 20, generally through a rivet aperture in the rivet island 46. The lift end 32 of the tab 26 is located opposite the tab nose 30 and provides access for a user to lift the lift end 32, such as with the user's finger.

Alternatively, the tab 26 may be attached to the center panel 12 by an adhesive.

Figure 2:
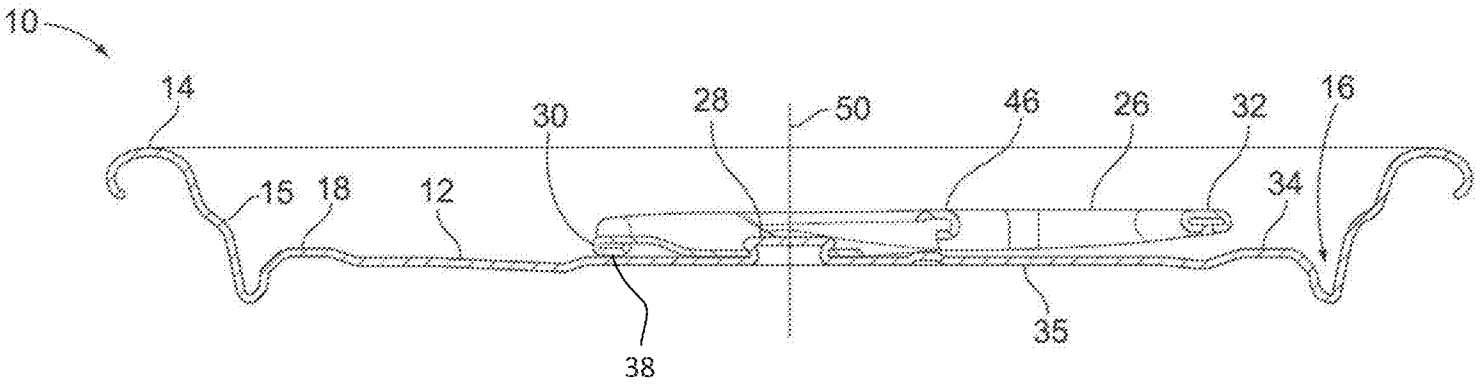
FIG. 2 is a cross-sectional view of a can end.
Figure 3:
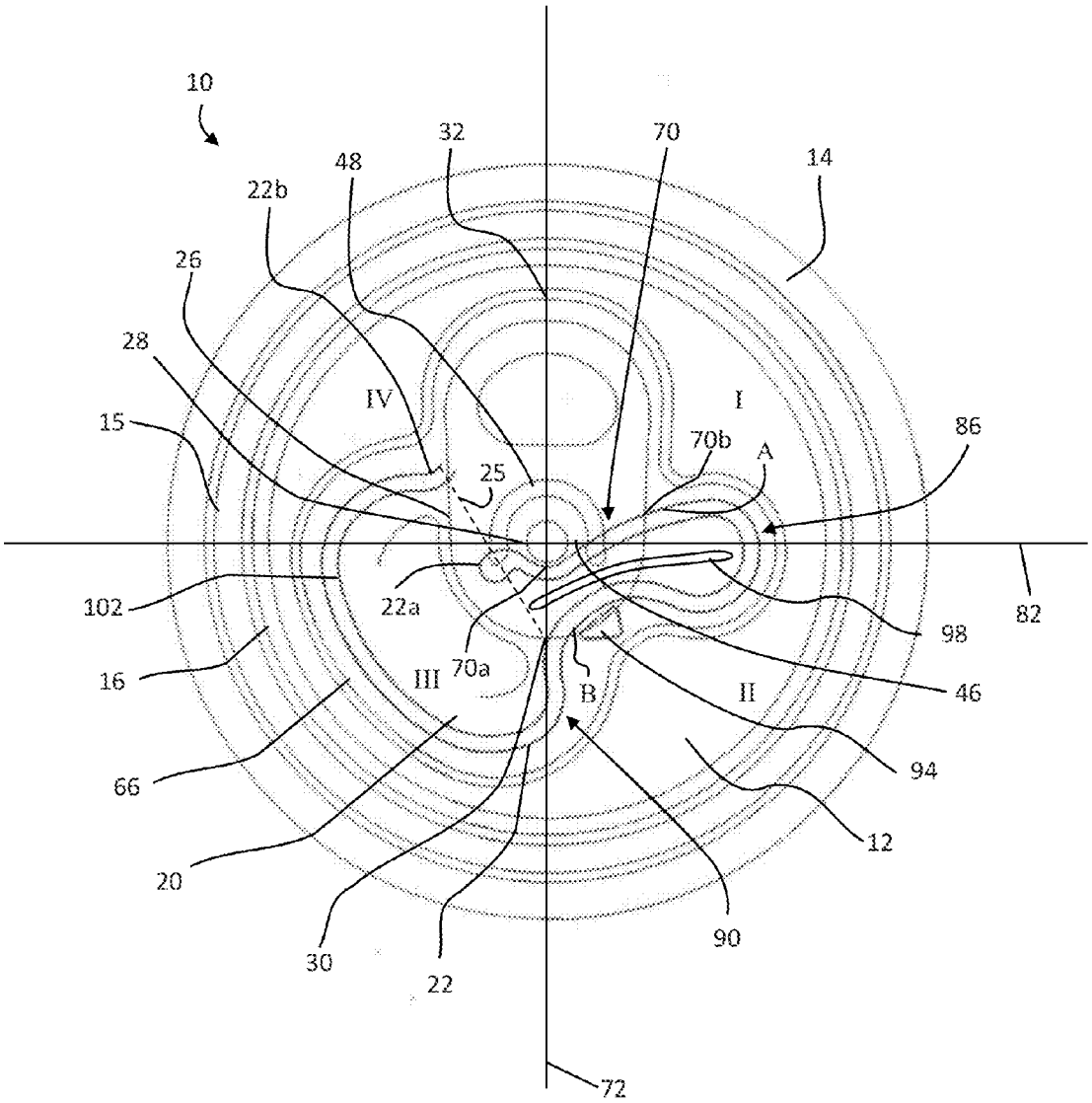
FIG. 3 is a top view of an embodiment of the present invention with a substantially translucent tab to reveal structure of a can end beneath the tab.

For purposes of this description, the nose end 30 refers to that portion of the perimeter of the tab 26 including the curl 38 (see FIG. 2) which is located within an arc area of a circular arc subtending a 90 degree angle. The circular arc has a center point at the center point of the rivet 28 and is bisected by the first axis 72 (see FIG. 11).

The rivet 28 is surrounded by a circular coined region of the center panel 12. The coined region is a compressed portion of the center panel 12 through which the score line 22 generally travels. A raised, curvilinear bead may be located about the coined region so that it partially surrounds the coined region.

The central webbing 42 of the tab 26 is located between the nose end 30 and the lift end 32. The central webbing 42 includes a hinge region and a rivet island 46 surrounding the rivet 28. An opening or void region 48 of the tab webbing 42 provides an exposed area of the center panel 12. The void region 48 has a curvilinear geometry which borders the rivet island 46 and at least partially surrounds the rivet 28, with a first leg of the void region 48 being disposed generally to one side of the rivet 28, and a second leg being generally disposed on an opposite side of the rivet 28. The hinge region of the tab webbing 42 includes a hinge line which is defined by a substantially straight line passing between a terminal end of the first leg and a terminal end of the second leg of the void region 48. It may also be necessary to add material to the tab webbing 42, modify the radius of the curl, add beading, or other strengthening means to ensure that this area is strong enough wherein the tab 26 bends at the hinge region during opening.

The void region 48 is within the tab webbing 42. The void region 48 may have a generally arch-shaped configuration. In this configuration, the rivet island 46 again follows the general shape of the void region 48.

Figure 4:
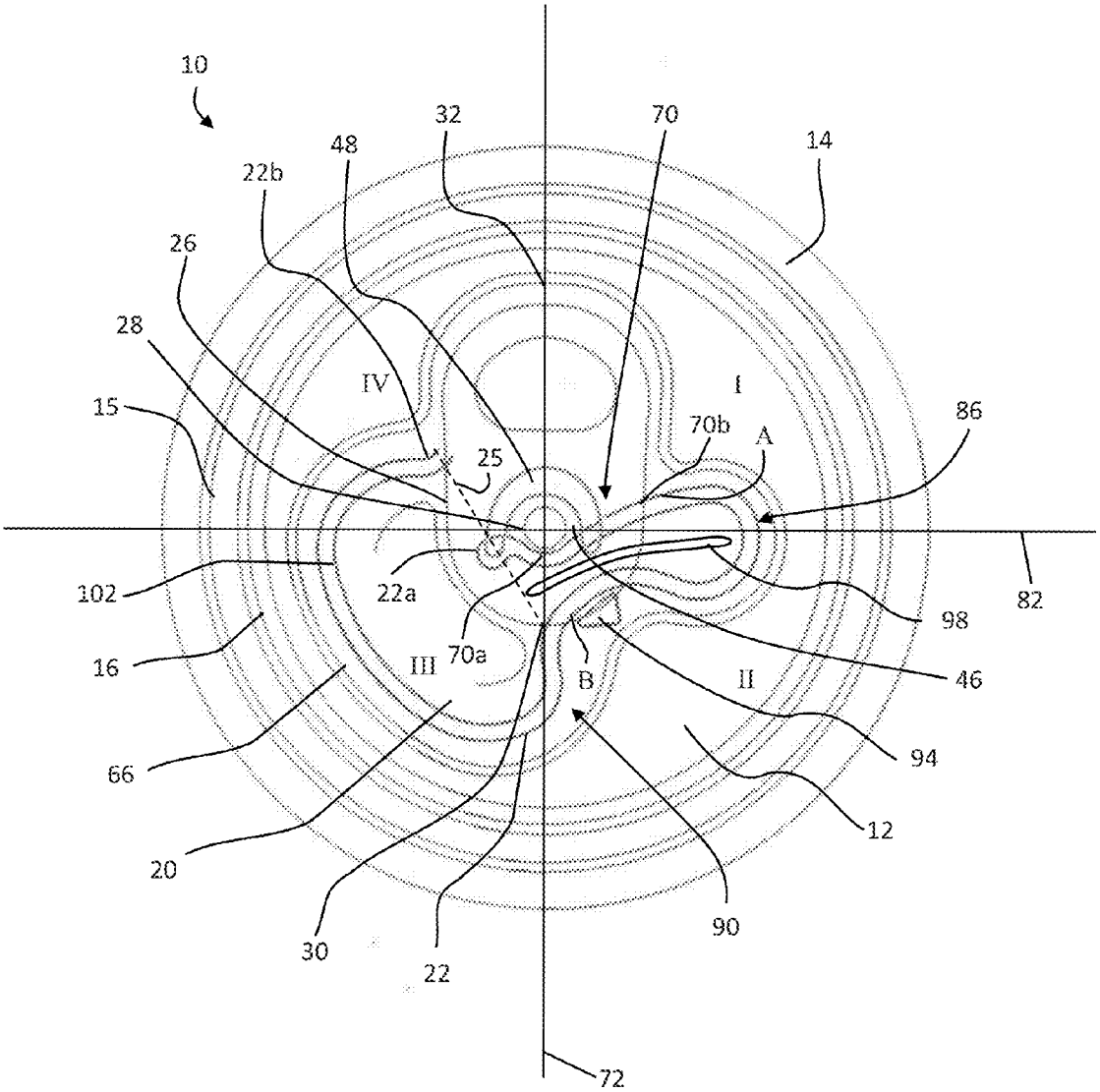
FIG. 4 is a top view of an embodiment of the present invention with a substantially translucent tab to reveal structure of a can end beneath the tab.
Figure 5:
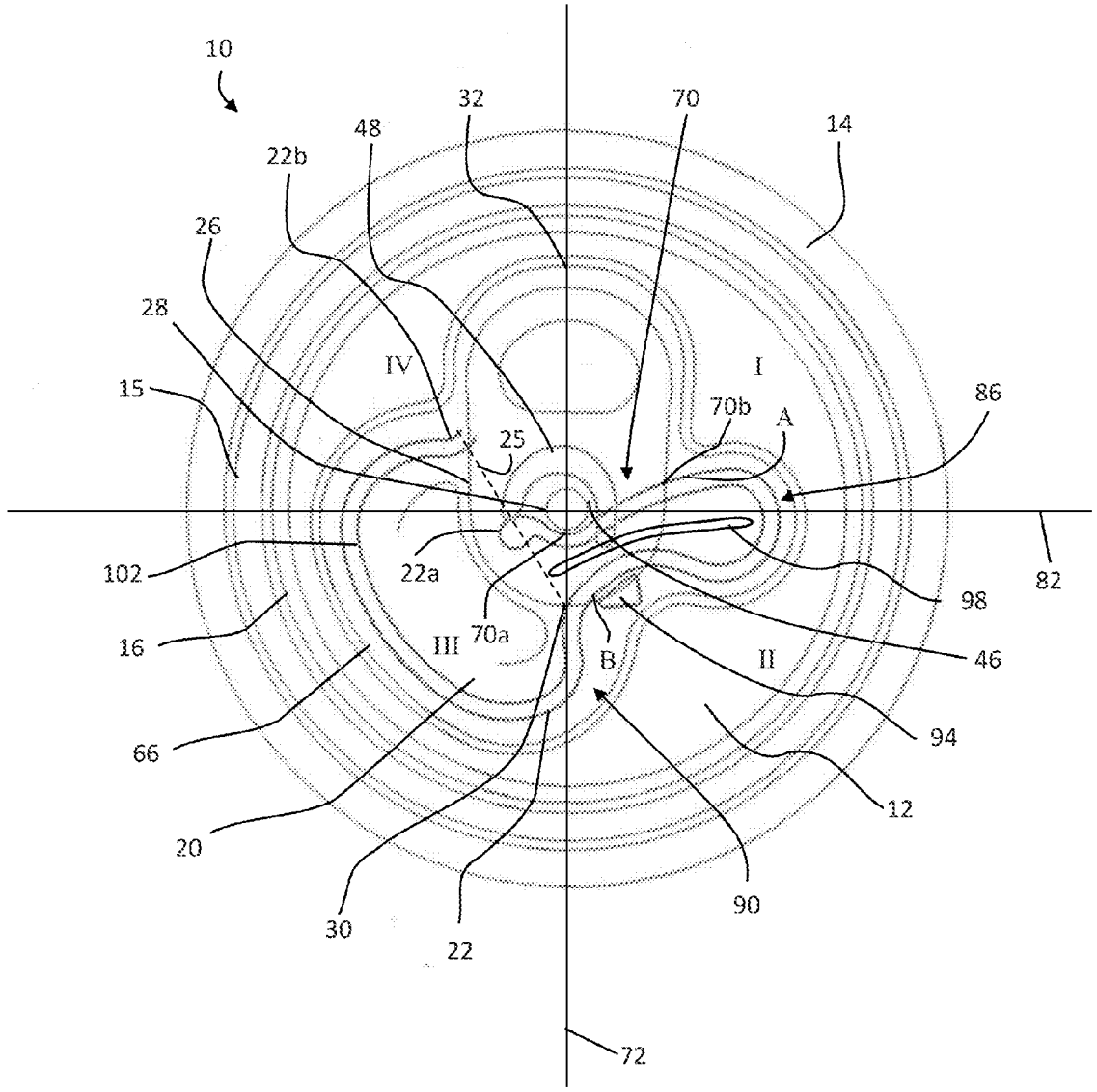
FIG. 5 is a top view of an embodiment of the present invention with a substantially translucent tab to reveal structure of a can end beneath the tab.

The hinge region of the tab 26 may be adapted to have a hinge line which is not perpendicular to an axis coincident with the diametric line. Rather, the hinge line intersects the first axis at an oblique angle. Thus, one embodiment of the present invention has a void region 48 with a first leg which is closer to an outer edge of the tab nose 30, and closer to the tear panel 20, than the second leg. Thus, the hinge line of the tab 26 is oriented at an oblique angle relative to the diametric line, as it is neither parallel nor perpendicular to the diametric line. See, e.g., FIGS. 4-6. The oblique hinge line is described in U.S. Pat. No. 6,024,239 which is hereby incorporated by reference as if fully set forth herein.

The alteration of the hinge line orientation relative to the first axis results in a structure which directs the path of the tab 26 during opening of the tear panel 20, caused by lifting force on the lift end 32 to rotate the tab 26 about the hinge line 44 and cause angular displacement of the tab body.

The figures represent only one example of the rivet island 46 configuration. However, those of ordinary skill in the art would understand that the rivet island 46 and the void region 48 can take any number of shapes without departing from the spirit of the invention, including but not limited to all notch or lance type rivet islands.

The webbing 42 further comprises a grab portion. The grab portion is adapted for user manipulation. Typically, the grab portion includes a finger hole or the like. The finger hole is separated from the void region 48 by a thin segment of the webbing 42, under which the raised bead lies.

A deboss panel 66 is formed in the public side 34 of the central panel 12. The deboss panel 66 is formed in the central panel 12 using conventional die-forming techniques. The tab 26 and the tear panel 20 are typically fully recessed within the deboss panel 66.

For purposes of description and location of elements, a first axis 72 of the can end 10 extends through the nose end 30 and lift end 32 of the tab 26 and through a center of the rivet 28, generally bisecting a tab of bilateral symmetry. Thus, the first axis 72 may have a length equal to a diameter of the can end 10, assuming a round can end 10. Therefore, in one embodiment the first axis 72 is a diametric axis. A second axis 82 is perpendicular to the first axis 72. It may also pass through the center point of the rivet 28. Therefore, it too may be a diametric axis. The first and second axes 72,82 create four quadrants I-IV of the can end 10 having substantially equal surface areas.

According to an embodiment of the present invention, the score line 22 travels or extends through all four quadrants of the can end 10. It has a beginning end 22*a* and a terminal end 22*b*.

As illustrated, for discussion purposes, and as is the case for all known commercially available beverage containers of this type, a portion of the score line 22 is severed during an opening sequence which progresses in a clockwise fashion from a vent region towards the terminal end 22*b* of the score line 22. One of ordinary skill in the art could readily adapt the teachings set forth herein to a can using a counterclockwise opening sequence if so desired.

Starting with the beginning end 22*a* and moving clockwise about the score line 22, the score line comprises a first segment 70. The first segment 70 is a first curvilinear segment of frangible score. This first segment 70 comprises a vent region 70*a* and a pressure equalization port region 70*b*. As is typically the case with most, if not all, commercially available ecology beverage can ends, the vent region 70*a* is located at least partially beneath the tab 26 and has a segment lying very close to the rivet 28. As will be described below, the vent region 70*a* is the location along the score line 22 where opening of the tear panel 20 is initiated. The vent region 70*a* is where an initial "pop" takes place and where an internal pressure within beverage container is safely exhausted during the opening sequence as the score line 22 in the vent region 70*a* is fractured. The concept of a vent region is generally well-known in the prior art, although the inventors believe the vent region 70*a* of their can end includes features not taught by the prior art.

Proceeding further clockwise about the score line 22 from the vent region 70*a*, the pressure equalization port region 70*b* is located adjacent the vent region 70*a*. This pressure equalization port region 70*b* is an automatically openable pressure equalization port. Stated another way, in the first segment 70 of the score line 22, the pressure equalization port region 70*b* automatically opens during the opening sequence forming a pressure equalization port or opening. This will be explained in more detail below.

It should be noted that the first segment 70 begins in the third quadrant of the can end 10 and proceeds from the third quadrant to the second quadrant and from the second quadrant upwardly to the first quadrant and radially outwardly relative to the center of the rivet 28.

A second segment 86 of the score line 22 continues from the first segment clockwise about the score line 22. The second segment 86 may be of a frangible or non-frangible score.

The second segment 86 begins in the first quadrant and continues to extend radially outwardly relative to the center of the rivet 28 and curving towards the second quadrant.

The second segment 86 continues curving until it extends into the second quadrant and the curve directs the second segment back radially inwardly relative to the center of the rivet 28.

A third segment 90 of the score line 22 continues from the second segment 86. The third segment 90 comprises a second curvilinear segment of frangible score. The second curvilinear segment of frangible score is fracturable to a location at, or very near, the terminal end 22*b* of the score line 22 to form the pour opening 20' as the tear panel 20 is forced downwardly into the beverage container during the opening sequence.

The third segment 90 preferably extends from the second segment 86 within the second quadrant through a curve adjacent a ramp 94 located radially outwardly of the third segment 90. The curve directs the third segment 90 radially outwardly relative to the center of the rivet 28 long or adjacent the first axis 72 separating the second quadrant from the third quadrant. The third segment 90 continues on a curvilinear path through the third quadrant and into the fourth quadrant similar to most commercially available LOE beverage container lids.

The pour panel 20 is defined by the third segment 90 and a hinge portion created between the terminal end 22*b* of the score line 22 and the onset of fracture of the second curvilinear segment of frangible score in the third segment 90.

It is contemplated that all or some portion of a length of the second segment 86 of the score line 22 will not fracture during the opening sequence. The entire length of the second segment 86 of the score line 22 extends between points A and B as shown in the figures. This structure and opening sequence allows for elimination of the check slot. The check slot is defined by a region of thickened residual in the score line 22 which slows propagation of the fracture of the score line 22 to allow the pressure in the beverage container to vent properly.

Alternatively, the second segment 86 of the score line 22 or a portion thereof may be absent altogether such that the first segment 70 of the score line 22 and the third segment of the score line 22 are separated by a non-scored region. This embodiment has a similar opening sequence to the other embodiments in that the vent region 70*a* opens initially followed by the equalization port region 70*b*; then the tear panel 20 opens forming the pour opening 20'.

Optionally, a curvilinear bead 98 may be formed in the center panel 12 for stiffening. The bead may be recessed or raised, but is preferably a recess. The bead 98 will stiffen or strengthen the area of the center panel 12 between the first and second segments 70,86 of the score line 22. The curvilinear bead 98 may extend to a point adjacent the third segment 90 between the first segment 70 and the third segment 90 such that the curvilinear bead 98 has a first end wherein the curvilinear bead 98 extends from a first point in the second quadrant adjacent the second axis 82 to a second end located at a second point in the second quadrant adjacent the first axis 72 and a distance farther away from the second axis 82 than the first point.

An anti-fracture score 102 may be place adjacent the score line 22 as is known in the art.

The opening sequence may be described as follows.

Figure 11:
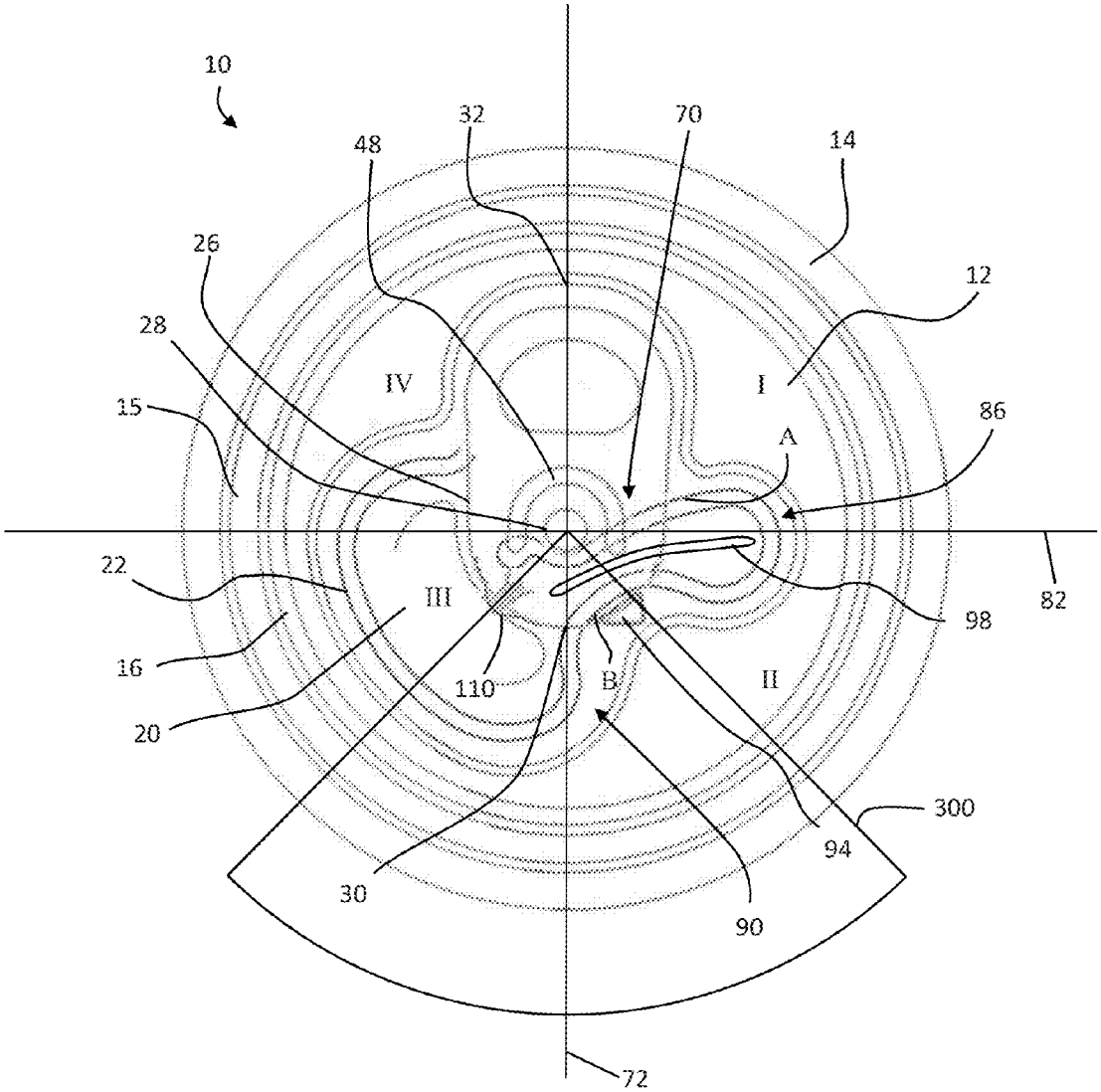
FIG. 11 is a top view of an embodiment of the present invention showing a portion of a nose end of a tab located within an arc area of a circular arc subtending a 90 degree angle wherein the circular arc has a center point at the center point of a rivet and is bisected by a first axis and wherein a portion of a cleat formed on the tab is also located within the arc area.

The tab 26 begins in a stowage position as illustrated (see, e.g. FIGS. 1, 3, and 4-6). The stowage position is the position of the tab 26 in which the beverage container is customarily delivered, i.e. handled subsequent to filling and prior to opening. Here, in the stowage position, the first axis 72 extends from the lift end 32 of the tab 26 through the nose end 30 of the tab 26. As shown in FIG. 11, a portion of the curl 38 of the nose end 30 of the tab 26 is located within an arc area or sector of a circular arc 300 subtending a 90 degree angle. The circular arc has a center point at the center point of the rivet 28 and is bisected by the first axis 72. The portion of the nose end 30 of the tab has a segment located outwardly of a boundary of the tear panel 20 when in the stowage position and prior to a user actuated lifting of the lift end 32 of the tab 26 which commences the opening sequence. Thus, in the present invention, the pour panel opening position, or score line opening position, is also the stowage position. This segment of the nose end 30 of the tab 26 located outwardly of the tear panel first contacts a portion of the center panel located beyond a boundary of the tear panel during initial lifting of the lift end of the tab which actuates the opening sequence. The user actuated lifting of the tab 26 is directed directly upwardly relative to the public side 34 of the center panel 12 without user introduced rotation of the rivet island 46 of the tab 26 about the rivet 28 in either a clockwise or counterclockwise direction.

Figure 12:
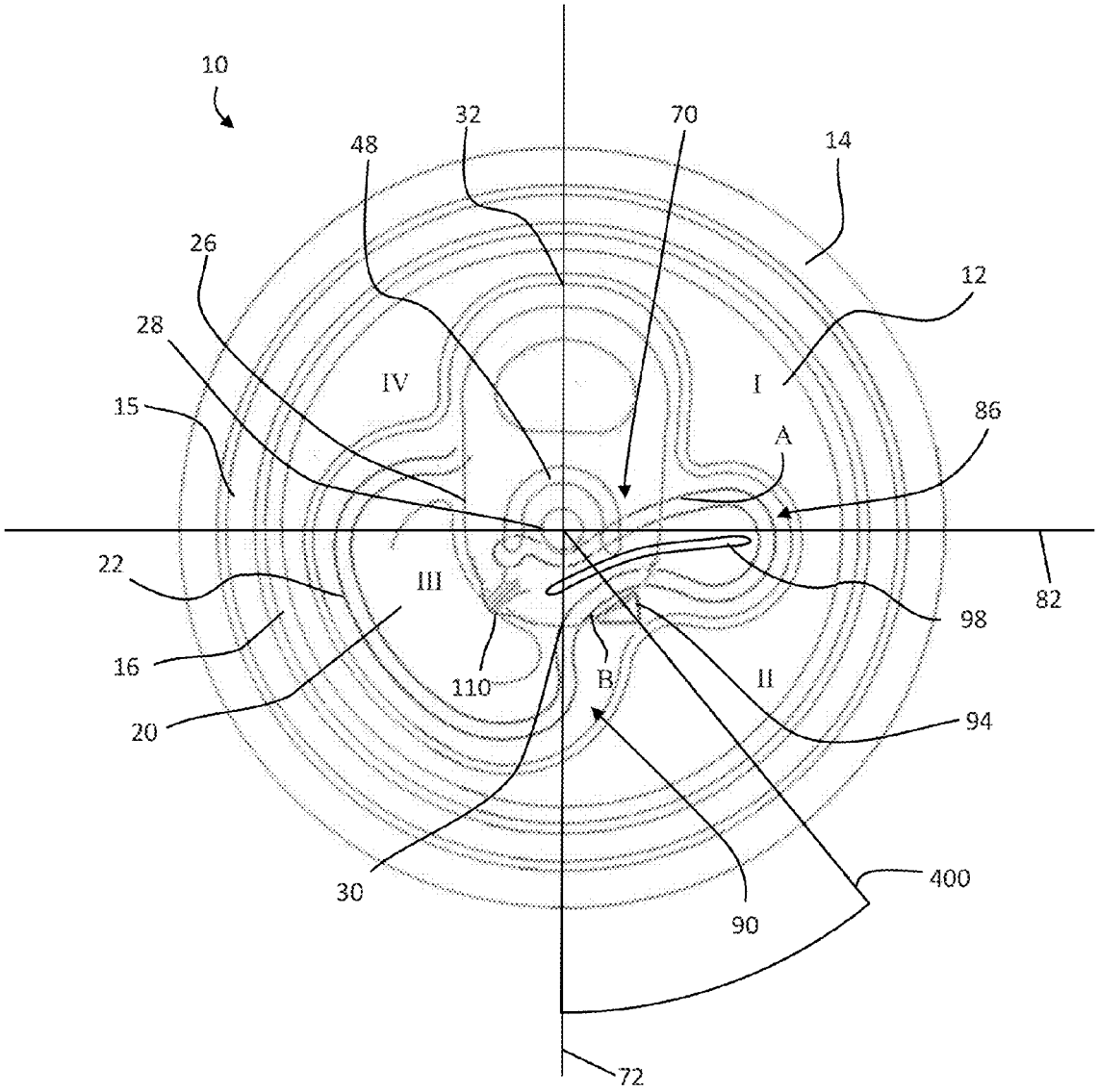
FIG. 12 is a top view of an embodiment of the present invention showing a preferred location of a portion of a nose end of a tab located within an arc area of a circular arc subtending a 45 degree angle wherein the circular arc has a center point at the center point of a rivet and wherein a first radius extends along a first axis between a second quadrant and a third quadrant and a second radius is located in the second quadrant.

More preferably, as illustrated in FIG. 12, the segment of the nose end 30 of the tab 26 which first contacts the center panel 12 during the opening sequence is located within an arc area of a sector of a circular arc 400 subtending a 45 degree angle. This circular arc 400 also has a center point at the center point of the rivet. However, this circular arc has a first radius extending along the first axis 72 between the second and third quadrants and a second radius located within the second quadrant such that the arc area of this circular arc 400 is located within the second quadrant.

In the stowage position and the initial score line breaking position, a portion of the nose end 30 of the tab 26 lying outside of the boundary of the tear panel 20 may engage the ramp 94. (See, e.g., FIGS. 3-5). This engagement prelifts the nose end 30 and biases the lift end 32 somewhat downwardly.

Figure 7:
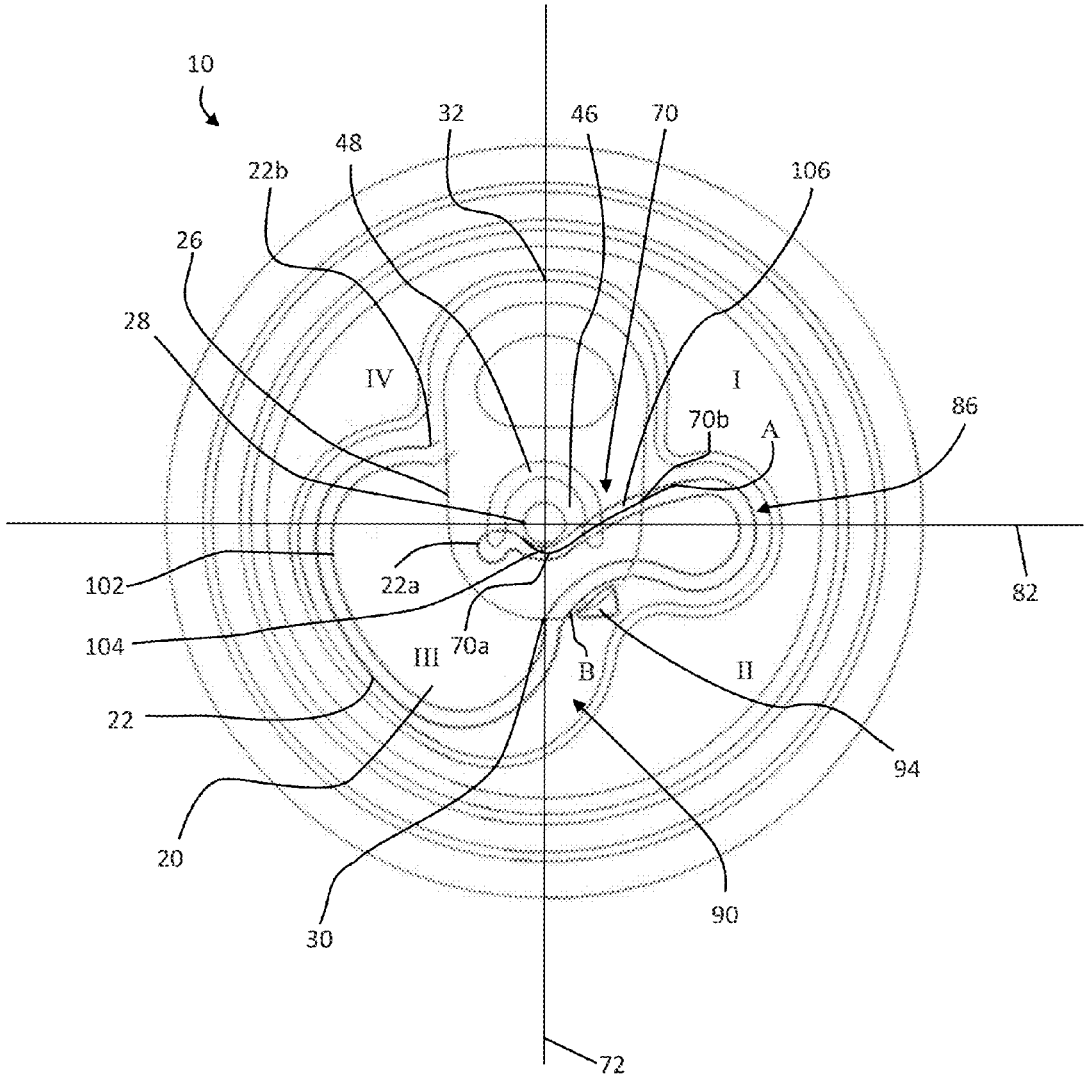
FIG. 7 is a top view of an embodiment of the present invention with a substantially translucent tab to reveal structure of a can end beneath the tab and illustrating a vent opening and pressure equalization port formed subsequent to initial lifting of a lift end of the tab during an opening sequence.

The tab nose 30 is forced against the ramp 94, and the score line 22 initially ruptures at a vent region 70*a* of the score line 22. This initial rupture of the score line 22 is primarily caused by the lifting force on the tab 26 resulting in lifting of a central region of the center panel 12, including and immediately adjacent the rivet 28, which causes separation of the residual metal of the score line 22 in the vent region 70*a*. The force required to rupture the score line 22 in the vent region 70*a*, typically referred to as the "pop" force, is a lower degree of force relative to the force required to propagate other regions of the score line 22 by continued lifting of the lift end 32 of the tab 26. (See FIG. 7).

Thus, similar to prior art can ends, the initial lifting of the tab 26 causes the first segment 70 of the score line 22 to fracture and the pressure within the beverage container to vent out of the beverage container as the vent region 70*a* is fractured forming a vent opening 104. Continued lifting of the tab 26 causes the fracture of the score line 22 in the first segment 70 to propagate to the pressure equalization port region 70*b* wherein the fracture of the score line 22 creates a pressure equalization port or opening 106 in the score line 22 through which the pressure within the beverage container may be equalized during pouring, resulting in a smoother pour.

It should be noted that the lifting of the lift end 32 of the tab 26 by the user causes the score line 22 in the vent region 70*a* to fracture. Continued lifting causes the pressure equalization port 106 to be formed as the score line 22 continues to fracture. At this point, bending deflection of the center panel 12 into a headspace above a beverage in a previously sealed container does not take place. The lifting of the lift end 32 of the tab 26 causes the tab nose 30 to initially press against the center panel 12 outside a periphery or boundary of the tear panel 20 in the area described above which provides further leverage against which the rivet 28 and the area of the center panel 12 near the rivet 28 to be lifted somewhat higher to propagate fracture of the first segment 70 past the vent region 70*a* and into the pressure equalization port region 70*b*.

Figure 10:
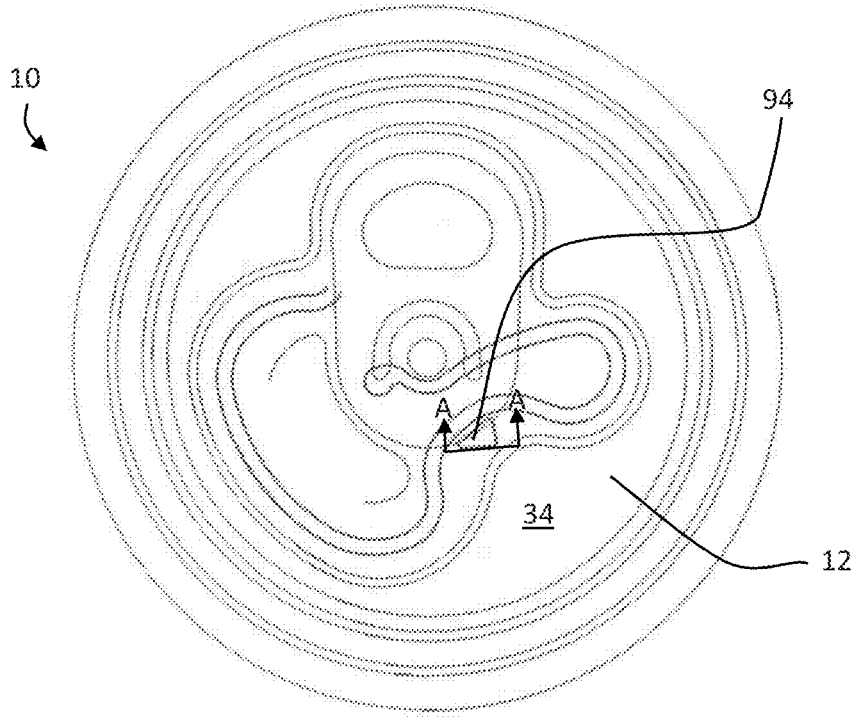
FIG. 10 is a top view of an embodiment of the present invention.
Figure 10A:
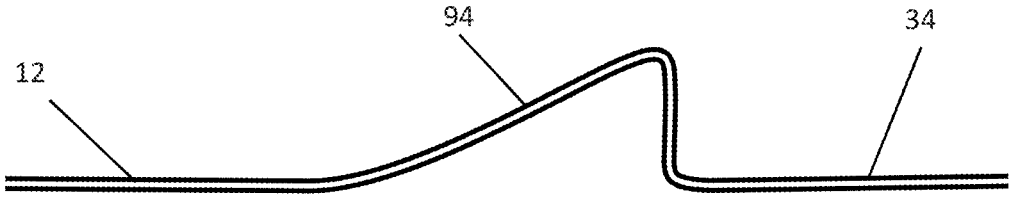
FIG. 10A is a cross-sectional view of a segment of a center panel illustrating a raised ramp which contributes to automatic rotation of a rivet island of a tab about a rivet attaching the tab to a can end according to an embodiment of the present invention.

Continued lifting of the tab 26 forces the nose end 30 against the ramp 94. The ramp 94 is tapered or angled (see FIGS. 10 and 10A) such that a force provided by the nose end 30 of the tab 26 migrates across the center panel 12 from the ramp 94 towards the tear panel 20. The taper or angle of the ramp 94 causes the rivet island 46 of the tab 26 to naturally rotate about the rivet 28 without the user consciously ceasing the lifting of the tab, then rotating the rivet island 46 of the tab 26 to position the nose end 30 of the tab 26 to a new location, before resuming the lifting of the tab 26 to fracture the score line 22. In the embodiment illustrated, the nose end 30 of the tab 26 rotates clockwise towards the tear panel 20. Thus, the angle or taper of the ramp 94 angles downwardly towards the third quadrant in the embodiment illustrated. This helps the tab deflect to the tear panel 20 during the opening sequence.

Figure 8:
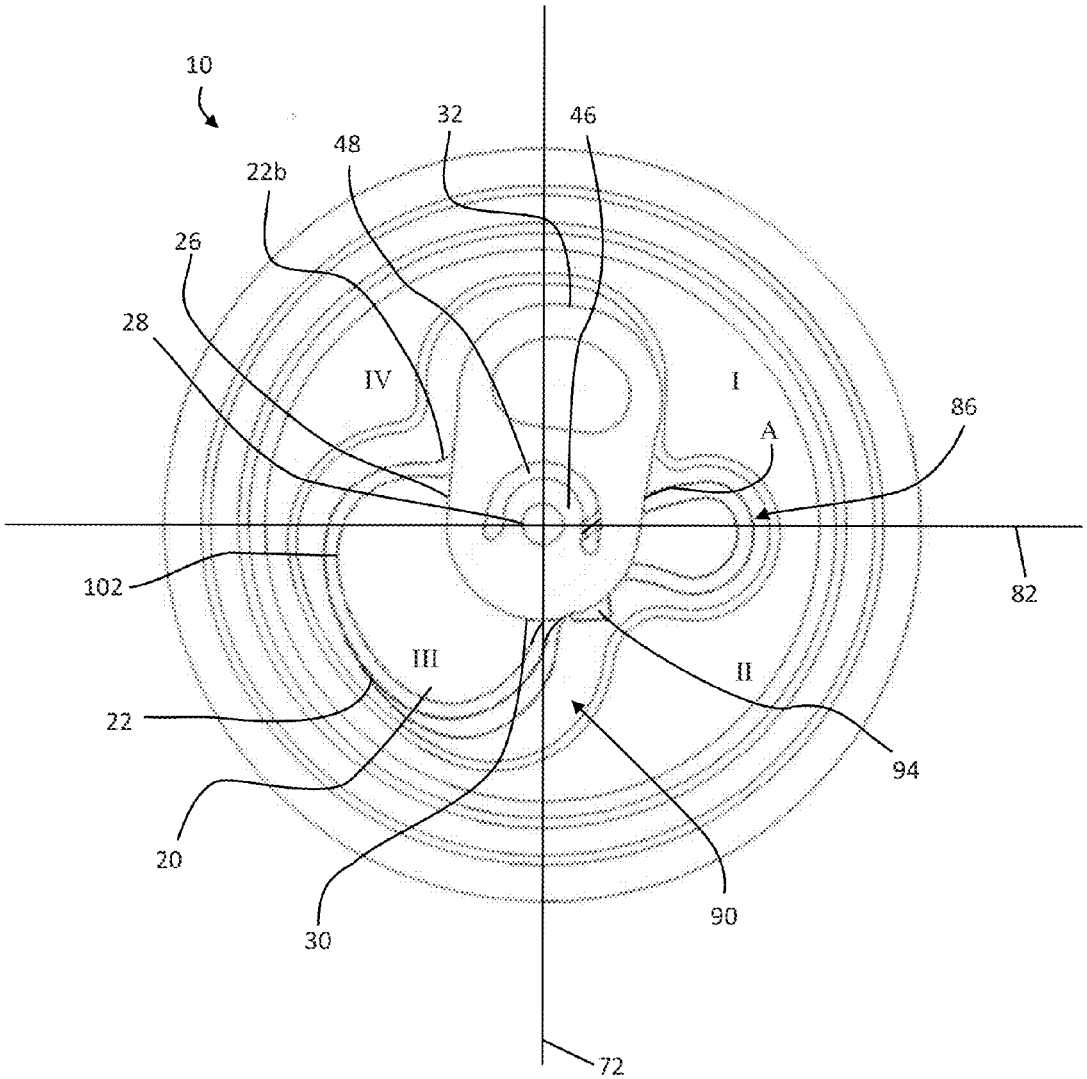
FIG. 8 is a top view of an embodiment of the present invention with a substantially opaque tab illustrating initial opening of a tear panel to form a pour opening and automatic rotation of the tab upon continued lifting of a lift end of the tab by a user.

Thus, a user actuated lifting of the lift end 32 of the tab 26 will actuate the opening sequence in which the first curvilinear segment of frangible score 70 is severed causing the vent opening 104 and the pressure equalization port 106 to form before the same lifting of the tab 26 causes the pour opening 20' to be completely formed. See, e.g., the sequence illustrated in FIGS. 7-9.

This differs from most prior art can ends. Typically, in the prior art, one of two opening sequences takes place. Either the tab 26 is lifted straight up and continues moving in the same direction to force the tear panel 20 downwardly into the beverage container. Or, the lifting of the tab 26 is paused, and the rivet island 46 of the tab 26 is manually rotated during this dwell period, then the lifting of the tab 26 is continued with the nose 30 relocated on the center panel 12. With the opening sequence of the present invention, no such dwell period or pause and manual rotation are necessary to relocate the nose end 30 of the tab 26, as the rotation of the rivet island 46 of the tab 26 about the rivet 28 occurs naturally with the lifting of the left end 32 of the tab 26.

As the force from the nose end 30 of the tab 26 migrates towards the tear panel 20, fracture of the third segment 90 of the score line 22 propagates towards the terminal end 22*b* of the score line 22 and the tear panel 20 is forced downwardly into a headspace of the beverage container. See, e.g., FIG. 8. As the pour opening 20' is fully developed, the hinge segment 25 forms between the terminal end 22*b* of the score line 22, past the rivet 28, and ends at the intersection of the second segment 86 and the third segment 90. See, e.g., FIG. 9. Thus, the hinge segment 25 extends from the fourth quadrant, through the third quadrant, and terminates in the second quadrant where the fracture in the third segment 90 of the score line 22 began.

Again, it is further contemplated that all or some portion of the second segment 86 of the score line 22 will not fracture during the opening sequence. Thus, there can be a length of unfractured score line 22 connecting the now fractured first segment 70 of the score line 22 with the now fractured third segment 90 of the score line 22.

The tab 26 may have one or more features that assist in fracturing the score line 22.

For example, typically, the rivet island 46 has a rivet hole therein through which the rivet 28 passes to attach the tab 26 to the remaining portion of the center panel 12. The rivet hole is located in the center of the rivet island equidistant from the portions of the legs of the void region 48 that extend along opposing sides of the void region 48. In one embodiment of the present invention, the rivet hole is offset from this center location wherein it favors one side of the rivet island 46 at the expense of the other. In other words, the rivet hole is located nearer one the legs of the void region 48.

In one embodiment, the rivet hole is placed to increase an overlap of the nose end of the tab 26 with the score line 22.

In the embodiment illustrated, the rivet hole is offset towards the longer of the opposing legs.

Figure 6:
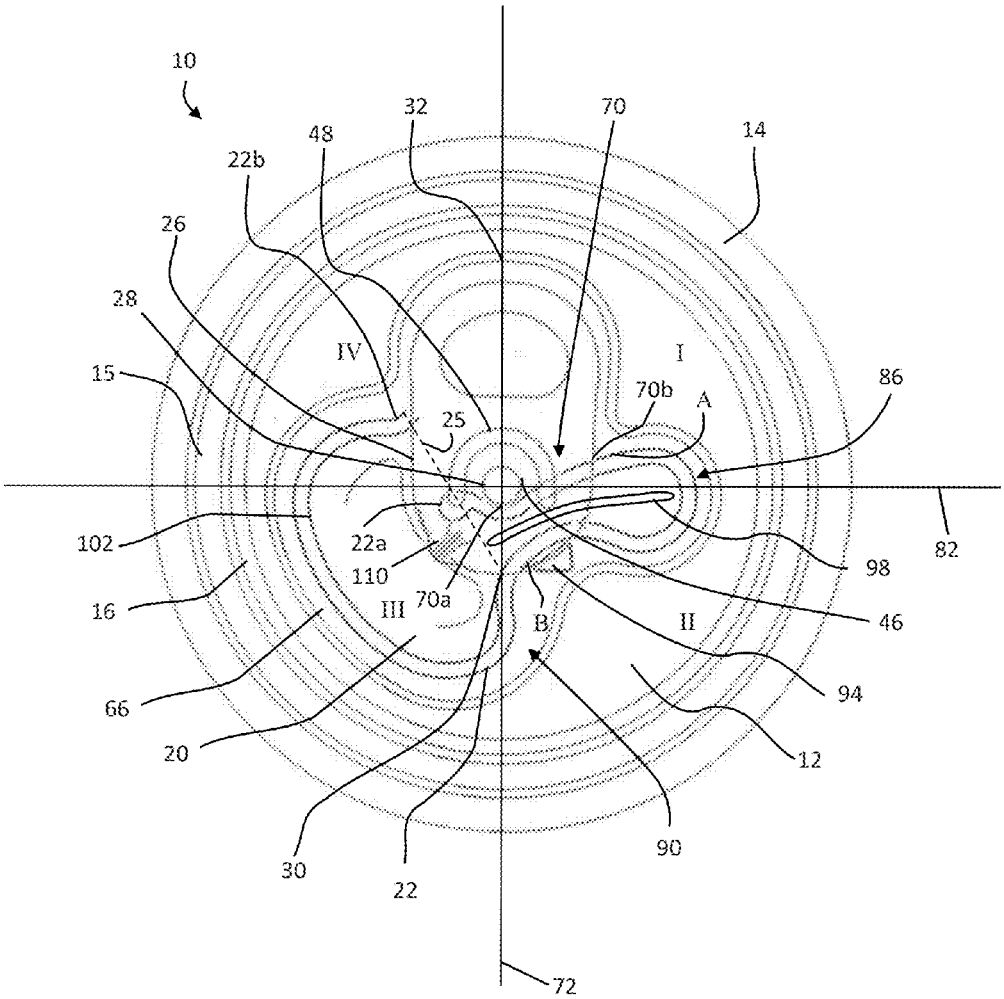
FIG. 6 is a top view of an embodiment of the present invention with a substantially translucent tab to reveal structure of a can end beneath the tab.

Additionally, the nose end 30 of the tab 26 may have a cleat 110 (see FIGS. 6 and 11). The cleat 110 is offset from a center line of the tab 26 defined by a segment of the first axis 72 as illustrated. Thus, the cleat 110 is located in the third quadrant of the can end when the tab 26 is in the stowage position and initial score line opening position as illustrated, and the tab 26 does not exhibit bilateral symmetry.

The cleat 110 is generally located in or at the nose end 30 of the tab 26 (see FIG. 2), preferably within the arc area of the circular arc 300 described above, more preferably offset from the center line of the tab 26 and within the third quadrant of the can end 10 when the tab 26 is in the stowage position and initial score line opening position (see FIGS. 6, 11 and 12).

Structurally, the cleat 110 comprises a compressed portion of the curled portion 38 of the tab 26 and a substantially V-shaped crevice on an upper surface of the tab 26. Thus, the cleat 110 has an upper surface exhibiting a V-shaped crevice and a lower surface extending downwardly towards the public side 34 of the tear panel 20.

The forming of the cleat 110 also forces the curled portion of the tab 26 radially outwardly relative to the center of the rivet 28. Thus, the cleat 110 extends radially outwardly from the nose end 30. This effectively lengthens the tab 26 at the cleat 110 wherein the cleat 110 extends farther outwardly than remaining portions of the nose end 30 of the tab 26.

Figure 13:
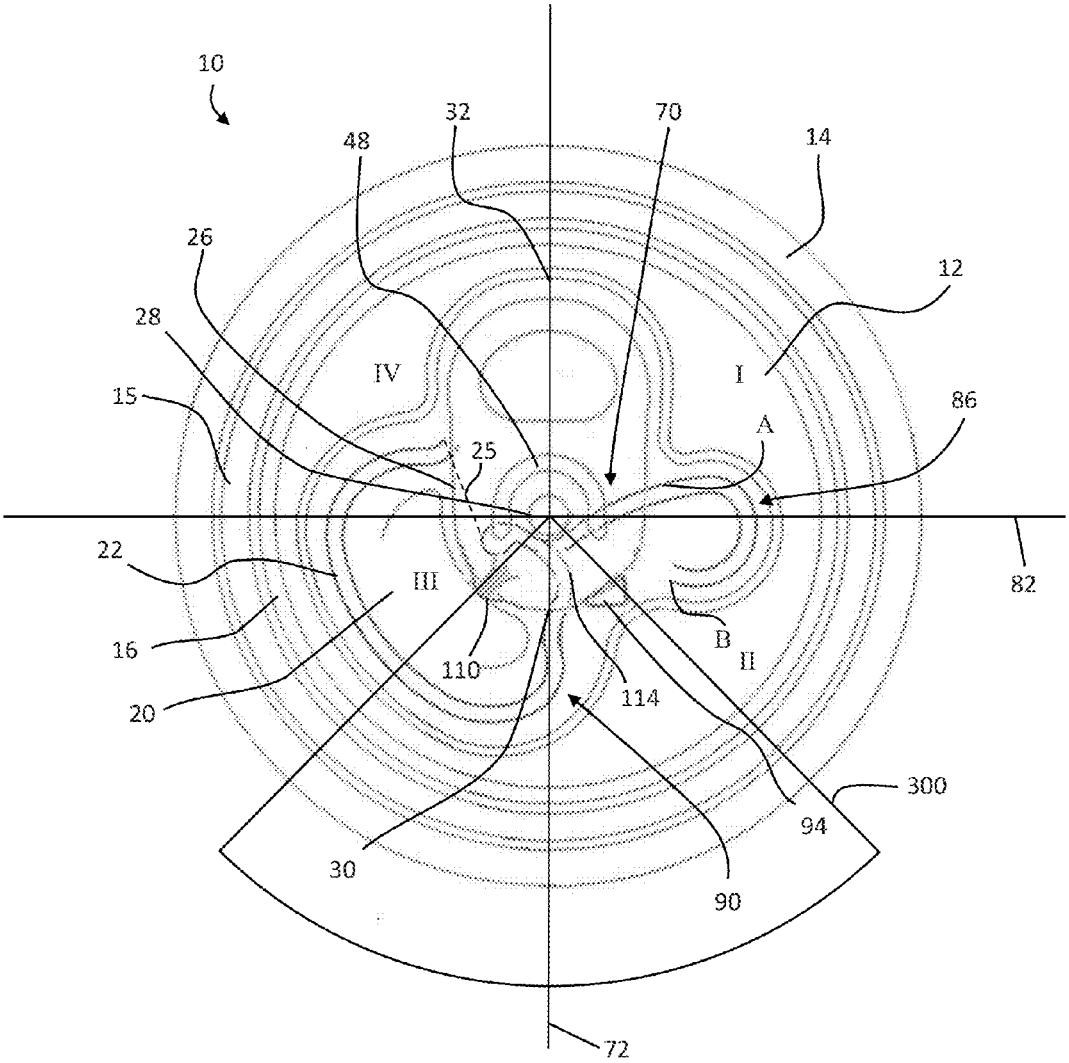
FIG. 13 is a top view of an alternative embodiment of the present invention showing a portion of a nose end of a tab located within an arc area of a circular arc subtending a 90 degree angle wherein the circular arc has a center point at the center point of a rivet and is bisected by a first axis and wherein a portion of a cleat formed ion the tab is also located within the arc area and wherein a bridge of the score creates a fork in a frangible score path wherein a breaking of the score proceeds in two separate directions at the fork to open a pressure equalization port along one direction of the fork and to open the tear panel to create a pour opening along a second direction of the fork.

An alternative embodiment is illustrated in FIG. 13. The opening of the can end 10 of this embodiment is actuated in an identical manner to that of the previous embodiments. The lift end 32 of the tab is lifted straight upwardly from the center panel 12 by the user without consciously rotating the tab about the rivet 28. A vent region of the score line 22 opens adjacent the rivet 28 wherein a pressure is safely released from the container as the first segment 70 of frangible score breaks or fractures.

The chief difference between the embodiment of FIG. 13 and the embodiment of FIG. 11 is as follows. Subsequent to initial venting of the pressure within the container, fracture of the score line 22 is bi-directional, continuing simultaneously in a first path along the first segment 70 of frangible score towards the second segment of frangible score 86 and in a second path along a bypass segment 114 of frangible score to the third segment 90 of frangible score. Fracture of the third segment 90 continues, and the tear panel 20 is deflected inwardly into the container just as in the description of the previous embodiments. The non-frangible hinge 25 is located similarly to prior can ends.

Figure 14:
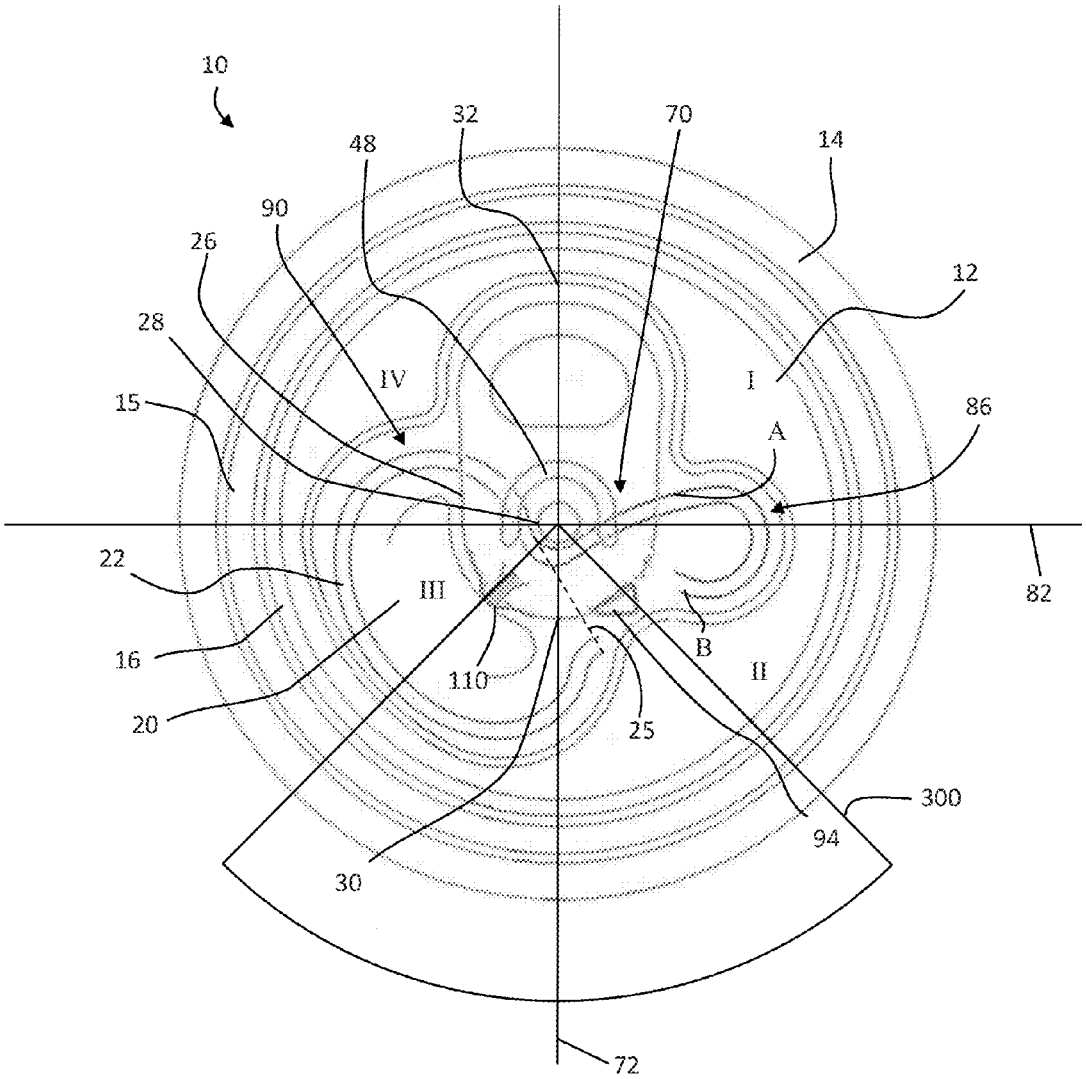
FIG. 14 is a top view of an alternative embodiment of the present invention showing a portion of a nose end of a tab located within an arc area of a circular arc subtending a 90 degree angle wherein the circular arc has a center point at the center point of a rivet and is bisected by a first axis and wherein a portion of a cleat formed on the tab is also located within the arc area and wherein the score line is designed to open bi-directionally such that the frangible score defining the tear panel fractures along a counterclockwise path while the frangible score that fractures to create a pressure equalization port opens in a clockwise path.

An alternative embodiment is illustrated in FIG. 14. Again, the opening of the can end 10 of this embodiment is actuated in an identical manner to that of the previous embodiments. The lift end 32 of the tab is lifted straight upwardly from the center panel 12 by the user without consciously rotating the tab about the rivet 28. A vent region of the score line 22 opens adjacent the rivet 28 wherein a pressure is safely released from the container as the first segment 70 of frangible score breaks or fractures.

The score line 22 of this embodiment is designed differently than the previous embodiments. Here, the non-frangible hinge segment 25 is located on an opposite side of the rivet 28 than the embodiment of FIG. 13.

In this embodiment, again, upon lifting of the lift end 32 of the tab 26, a vent region is formed adjacent the rivet 28. Fracture of the score line 22 of this embodiment is bi-directional as in the previous embodiment; however; there is no fork in the score line 22 in this embodiment. Using a clock-like reference, the fracture of the first segment of frangible score 70 proceeds in a first direction towards the second segment 86 of frangible score to form a pressure equalization port. Simultaneously, fracture of the third segment 90 of frangible score proceeds in an opposite direction. As lifting of the lift end 32 of the tab 26 continues, the tab 26 rotates about the rivet 28 the manner described above relative to the previous embodiments; the fracture of the third segment 90 of frangible score continues; and the tear panel 20 is deflected into the container to form the pour opening.

In the example illustrated in FIG. 14, the fracture of the first segment 70 proceeds in a clockwise-like direction, while the fracture of the third segment 90 proceeds in a counterclockwise-like direction.

It should be noted further that the inventors have produced containers having vent regions 104, pressure equalization ports 106, and pour openings 20' located and sized according to the description set forth herein. The pressure equalization ports 106 of these containers improved the flow of beverage from the container such that a laminar flow of the beverage was achieved without unacceptable 'glug".

The terms "first," "second," "upper," "lower," "top," "bottom," etc. are used for illustrative purposes relative to other elements only and are not intended to limit the embodiments in any way. The term "plurality" as used herein is intended to indicate any number greater than one, either disjunctively or conjunctively as necessary, up to an infinite number. The terms "joined," "attached," and "connected" as used herein are intended to put or bring two elements together so as to form a unit, and any number of elements, devices, fasteners, etc. may be provided between the joined or connected elements unless otherwise specified by the use of the term "directly" and/or supported by the drawings.

While the specific embodiments have been illustrated and described, numerous modifications come to mind without significantly departing from the spirit of the invention, and the scope of protection is only limited by the scope of the accompanying Claims.

What is claimed is:

1. An ecology stay-on tab beverage can end comprising:

a circumferential curl centered about a longitudinal axis;

a circumferential wall extending downwardly from the curl;

a circumferential strengthening member located downwardly from the wall; and a center panel located radially inwardly from the strengthening member and centered about the longitudinal axis comprising:

a rivet attaching a tab to the center panel;

a first curvilinear segment of frangible score severable to form a vent opening and a pressure equalization port;

a second curvilinear segment of frangible score having opposing terminal ends separated by a non-frangible hinge segment of the center panel, the second curvilinear segment of frangible score being severable to form a pour opening, wherein a lifting of a lift end of the tab actuates an opening sequence in which the first curvilinear segment of frangible score is severed causing the vent opening and the pressure equalization port to form before the same lifting of the tab causes the pour opening to be completely formed, and wherein a score line having opposing terminal ends and comprising the first curvilinear segment of frangible score adjacent a first terminal end of the score line and extending therefrom and a non-frangible segment of the score line joining the first curvilinear segment of frangible score with the second curvilinear segment of frangible score, wherein the second curvilinear segment of frangible score extends from the non-frangible segment of the score line to a second terminal end of the score line.

2. The ecology stay-on tab beverage can end of claim 1 further comprising:

a tear panel defined by the second curvilinear segment of frangible score and the non-frangible hinge segment which retains the tear panel to an adjacent portion of the center panel when the pour opening is formed;

a first diametric axis of the ecology stay-on tab beverage can end extending lengthwise through the tab from the lift end of the tab to a nose end of the tab opposite the lift end wherein a curled portion of the nose end of the tab lying within an arc area of a first circular arc subtending a 90 degree angle, having a center point at the center point of the rivet and bisected by the first diametric axis, has a segment located outwardly of the tear panel when the lifting of the lift end of the tab actuates the opening sequence;

a second diametric axis perpendicular to the first diametric axis wherein four quadrants of substantially equal area of the ecology stay-on tab beverage can end are formed.

3. The ecology stay-on tab beverage can end of claim 2 wherein the segment of the nose end of the tab located outwardly of the tear panel first contacts a portion of the center panel located beyond a boundary of the tear panel upon initial lifting of the lift end of the tab which actuates the opening sequence.

4. The ecology stay-on tab beverage can end of claim 3 wherein the curled portion of the nose end of the tab is located within an arc area of a second circular arc subtending a 45 degree angle wherein the second circular arc has a center point at the center point of the rivet, wherein a first radius of the second circular arc extends along the first diametric axis between the second and third quadrants, and a second radius of the second circular arc is located in the second quadrant such that the arc area of the second circular arc is located with the second quadrant.

5. The ecology stay-on tab beverage can end of claim 2 wherein the nose end of the tab has a cleat which extends over the tear panel when the lifting of the lift end of the tab actuates the opening sequence.

6. The ecology stay-on tab beverage can end of claim 1 further comprising:

a first diametric axis of the ecology stay-on beverage tab extending lengthwise through the tab from the lift end of the tab to a nose end of the tab opposite the lift end when the tab is in position to begin the opening sequence;

a second diametric axis perpendicular to the first diametric axis wherein four quadrants of substantially equal area of the ecology stay-on tab beverage can end are formed; and wherein the score line has portions located in each of the four quadrants.

7. The ecology stay-on tab beverage can end of claim 1 wherein the tab comprises a central webbing and a void region partially surrounding a rivet island, the void region having opposing legs extending along opposite sides of the rivet island, the rivet island having a rivet hole through which the rivet passes, wherein the rivet hole is offset on the rivet island such that it is located closer to a first opposing leg than a second opposing leg.

8. The ecology stay-on tab beverage can end of claim 1 further comprising:

a tear panel defined by the second curvilinear segment of frangible score and a non-frangible hinge segment which retains the tear panel to an adjacent portion of the center panel when the pour opening is formed; and a raised ramp located on the center panel outwardly of the tear panel, wherein a portion of the nose end of the tab engages the raised ramp during the opening sequence wherein a force provided by the tab nose to the center panel migrates towards the tear panel.

9. The ecology stay-on tab beverage can end of claim 1 wherein the opening sequence comprises, in order, formation of the vent opening and formation of the pressure equalization port upon severing the first curvilinear segment of frangible score until the severing of the first curvilinear segment of frangible score ceases.

10. The ecology stay-on tab beverage can end of claim 1 wherein the pour opening has an area no less than 0.25 square inches.

11. The ecology stay-on tab beverage can end of claim 1 wherein the pour opening is created as the lifting of the tab continues without manual rotation of the tab by a user.

12. The ecology stay-on tab beverage can end of claim 1 wherein the score line has a third curvilinear segment of frangible score of the score line joining the first curvilinear segment of frangible score with the second curvilinear segment of frangible score, wherein the second curvilinear segment of frangible score extends from the third curvilinear segment of frangible score line to a second terminal end of the score line.

13. The ecology stay-on tab beverage can end of claim 1 wherein the lifting of the tab occurs from a stowage position of the tab without manual rotation of tab prior to lifting of the tab from the stowage position.

14. The ecology stay-on tab beverage can end of claim 13 wherein the opening sequence is completed without manually rotating a rivet island of the tab about the rivet.

15. The ecology stay-on tab beverage can end of claim 1 wherein lifting of the tab causes a rivet island of the tab to rotate about rivet without conscious tab rotation provided by a user.

16. The ecology stay-on tab beverage can end of claim 1 wherein the score line further comprises a fork wherein during the opening sequence, fracture of the score line becomes bi-directional at the fork, simultaneously continuing in a first path along the first curvilinear segment of frangible score and in a second path along a bypass segment of frangible score to the second curvilinear segment of frangible score.

17. The ecology stay-on tab beverage can end of claim 1 wherein during the opening sequence, according to a clock-like reference, a fracture of the first curvilinear segment of frangible score proceeds in a first direction to form the pressure equalization port as a fracture of the second curvilinear segment of frangible score proceeds in an opposite direction.

18. An ecology stay-on tab beverage can end comprising:

a circumferential curl centered about a longitudinal axis;

a circumferential wall extending downwardly from the curl;

a circumferential strengthening member located downwardly from the wall;

a center panel located radially inwardly from the strengthening member and centered about the longitudinal axis comprising:

a rivet attaching a tab to the center panel;

a first curvilinear segment of frangible score severable to form a vent region and a pressure equalization port;

a second curvilinear segment of frangible score having opposing terminal ends separated by a non-frangible hinge segment of the center panel, the second curvilinear segment of frangible score being severable to form a pour opening, wherein a lifting of a lift end the tab actuates an opening sequence in which a nose end of the tab engages the center panel at a location outside a boundary of the pour opening and migrates to a location within the boundary of the pour opening.

19. An ecology stay-on tab beverage can end comprising a circumferential curl centered about a longitudinal axis;

a circumferential wall extending downwardly from the curl;

a circumferential strengthening member located downwardly from the wall; and a center panel located radially inwardly from the strengthening member and centered about the longitudinal axis comprising:

a tear panel defined by a frangible score having terminal ends separated by a non-frangible hinge segment which retains the tear panel to the center panel upon opening the ecology stay-on tab beverage can end; and a rivet attaching a tab to the center panel, wherein the tab comprises:

a central webbing;

a rivet island having a rivet hole through which the rivet passes;

a void region partially surrounding a rivet island having opposing legs extending along opposite sides of the rivet island; and a tab hinge extending from between the opposing legs, wherein the rivet hole is offset on the rivet island such that it is located closer to a first opposing leg than a second opposing leg.

20. An ecology stay-on tab beverage can end comprising:

a circumferential curl centered about a longitudinal axis;

a circumferential wall extending downwardly from the curl;

a circumferential strengthening member located downwardly from the wall;

a center panel located radially inwardly from the strengthening member and centered about the longitudinal axis comprising:

a tab attached to the center panel, the tab comprising:

a central webbing; and a rivet island having a rivet hole through which the rivet passes; and a tear panel defined by a frangible score having terminal ends separated by a non-frangible hinge segment which retains the tear panel to the center panel upon opening the ecology stay-on tab beverage can end, and a raised ramp forming a tapered surface on a public side of the center panel wherein engagement by a nose end of the tab with the raised ramp causes rotation of the rivet island about the rivet during the single lifting motion of the lift end of the tab, wherein a single lifting motion of a lift end of the tab without manually rotating the rivet island about the rivet creates, in order, a vent opening, a pressure equalization port and a pour opening.

21. In an ecology stay-on tab beverage can an improvement in an opening sequence comprising: a lifting of a lift end of a tab by a user causing a score line in a vent region to fracture and a continued lifting of the lift end causes a pressure equalization port to be formed as the score line continues to fracture as the lifting of the lift end of the tab causes a nose end of the tab to initially press against an area of the can end which is outside a periphery of a tear panel on the center panel providing further leverage against which a rivet attaching the tab to the center panel is further lifted to propagate fracture of the score line past a vent region and into a pressure equalization port region to open the pressure equalization port prior to opening a pour opening upon continued lifting of the lift end of the tab.

* * * * *